US008281456B2

(12) United States Patent
Finke

(10) Patent No.: US 8,281,456 B2
(45) Date of Patent: Oct. 9, 2012

(54) UPRIGHT VACUUM CLEANER

(75) Inventor: Christian Finke, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1057 days.

(21) Appl. No.: 12/199,368

(22) Filed: Aug. 27, 2008

(65) Prior Publication Data

US 2009/0056065 A1 Mar. 5, 2009

(30) Foreign Application Priority Data

Aug. 30, 2007 (DE) ..... 10 2007 040 954

(51) Int. Cl.
*A47L 9/32* (2006.01)

(52) U.S. Cl. ..... 15/410; 15/351

(58) Field of Classification Search ..... 15/351, 15/410; *A47L 9/32*
See application file for complete search history.

(56) References Cited

U.S. PATENT DOCUMENTS

| | | | | |
|---|---|---|---|---|
| 2,300,204 | A * | 10/1942 | Carlson | 15/333 |
| 5,794,305 | A | 8/1998 | Weger | |
| 7,823,251 | B2 * | 11/2010 | Dyson et al. | 15/336 |
| 2003/0051307 | A1 | 3/2003 | Hashizume et al. | |
| 2009/0056064 | A1 | 3/2009 | Finke et al. | |

FOREIGN PATENT DOCUMENTS

| | | | |
|---|---|---|---|
| CA | 2 181 876 | A1 | 1/1998 |
| EP | 0708613 | A1 | 5/1996 |
| GB | 2342282 | A | 4/2000 |
| GB | 2410178 | A | 7/2005 |
| GB | 2422094 | A | 7/2006 |
| WO | WO 2006/069334 | A2 | 6/2006 |
| WO | WO-2007008770 | A2 | 1/2007 |

OTHER PUBLICATIONS

European Search Report for EP 08 01 4602, dated Nov. 2, 2010.

* cited by examiner

*Primary Examiner* — David Redding
(74) *Attorney, Agent, or Firm* — Leydig, Voit & Mayer, Ltd.

(57) ABSTRACT

An upright vacuum cleaner for cleaning a surface includes an upper body with a handle, a base unit and a carriage configured to move the base unit on the surface. The carriage includes a wheel disposed in a rear portion of the base unit. A motor-fan unit is disposed in the base unit and configured to create a partial vacuum at the surface. A tilting joint provides for relative tilting between the upper body and the base unit. The tilting joint has a pivot axis extending in a horizontal direction when the vacuum cleaner is in a position of use. The wheel is mounted on a pivotable carrier member, which has a pivot axle that is spaced apart from a rotatable axle of the wheel. A pivoting mechanism is disposed on the tilting joint in a vicinity of the carrier member and is configured to pivot the carrier member and the wheel during a pivoting movement of the upper body relative to the base unit.

19 Claims, 10 Drawing Sheets

Section H - H

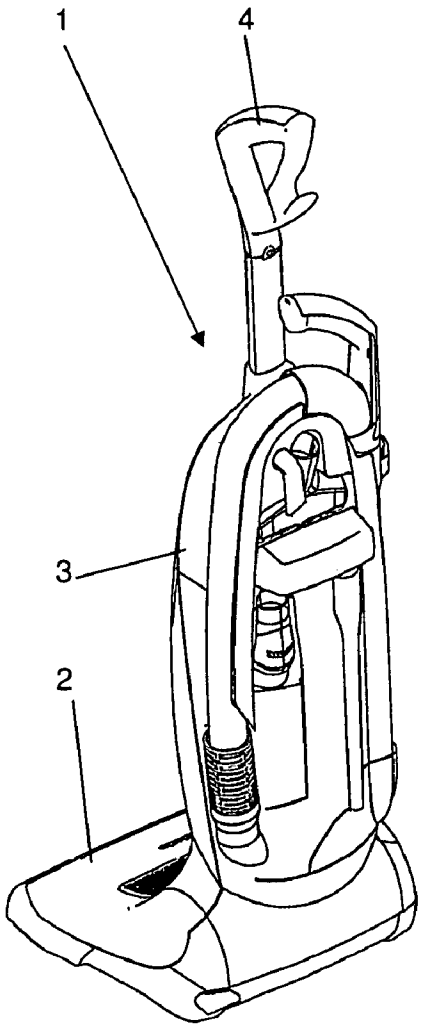
Fig. 3
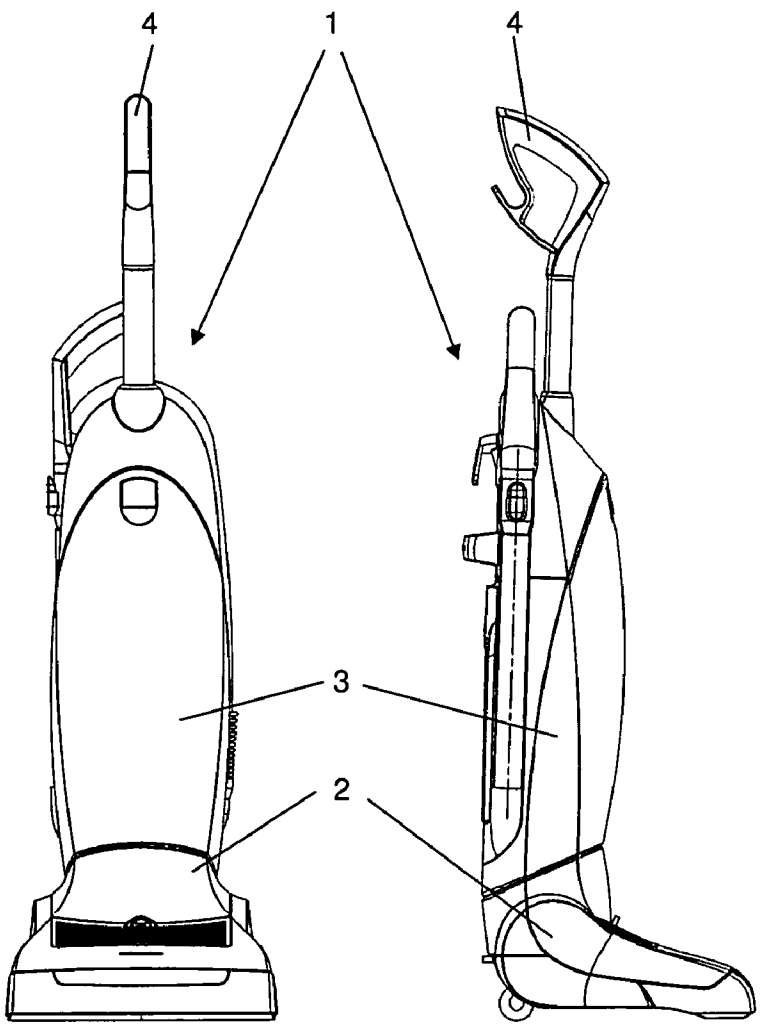
Fig. 2
Fig. 1

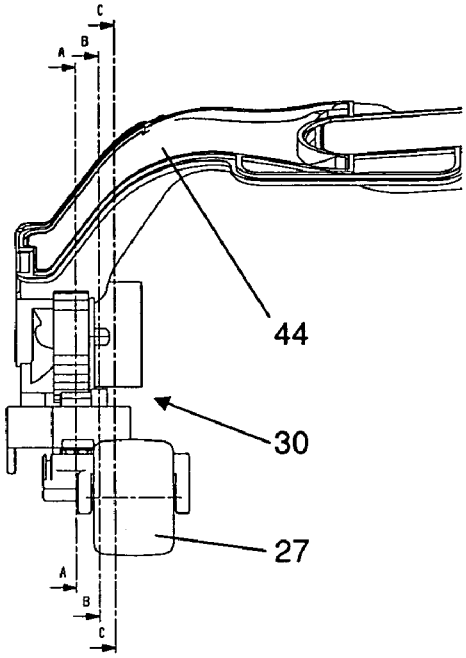
Fig. 14a
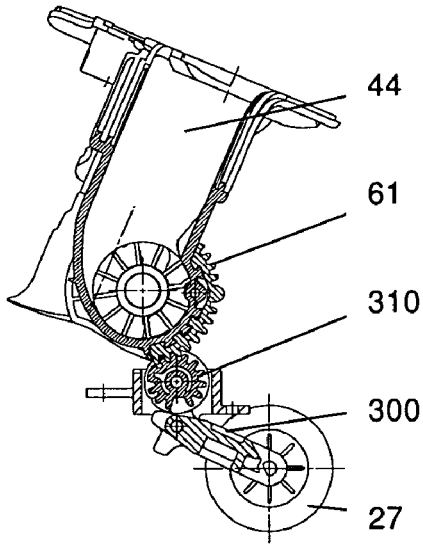
Fig. 14b Section A - A
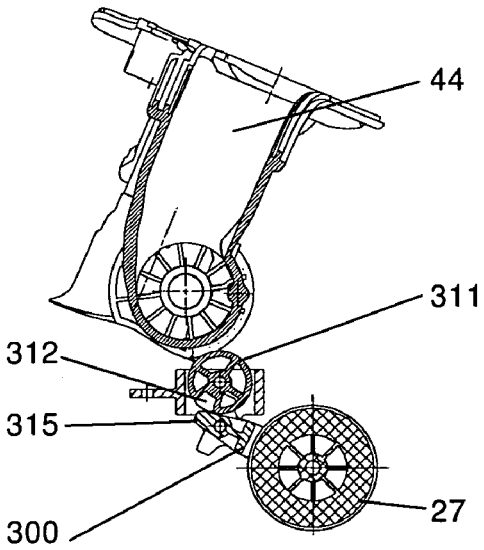
Fig. 14c Section B - B
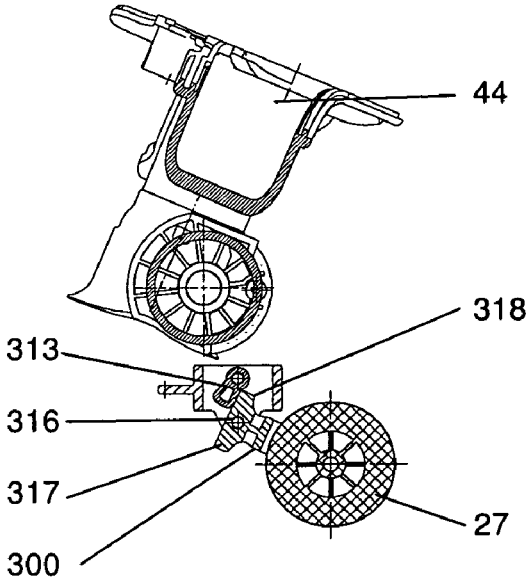
Fig. 14d Section C - C

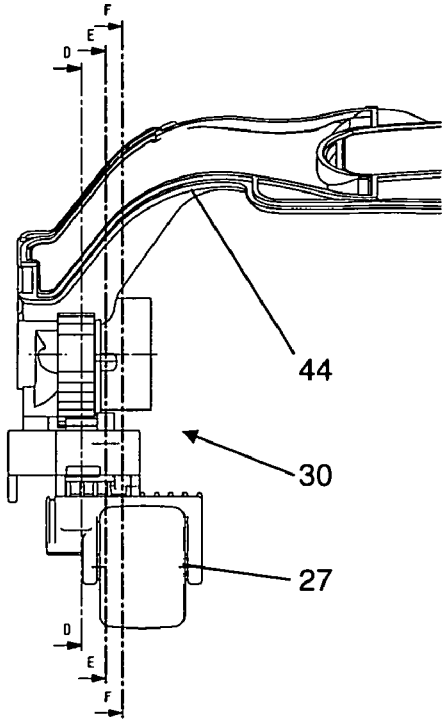
Fig. 15a
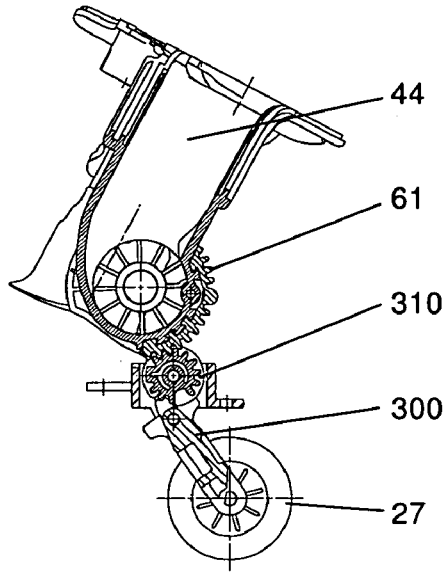
Fig. 15b Section D - D
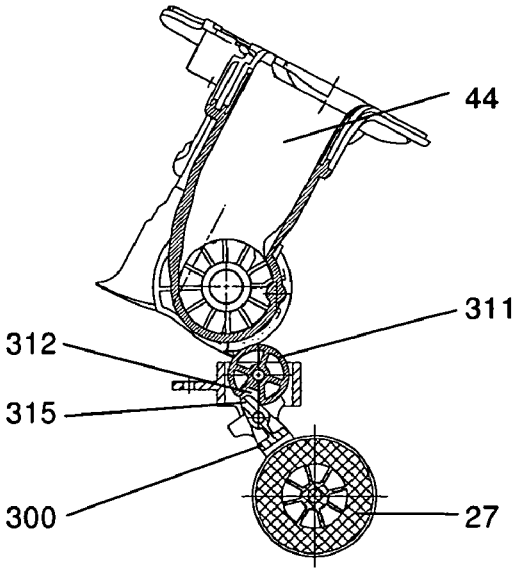
Fig. 15c Section E - E
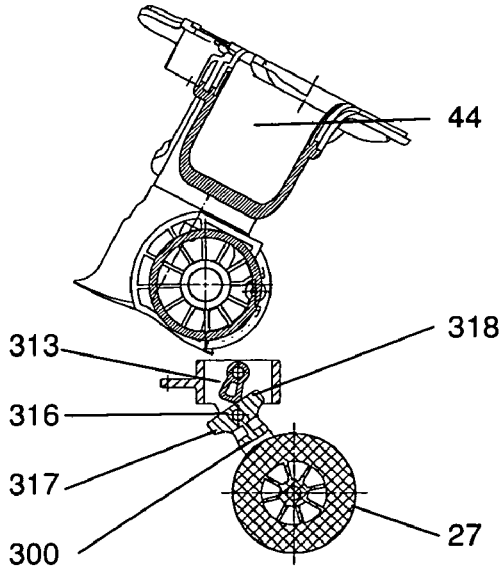
Fig. 15d Section F - F

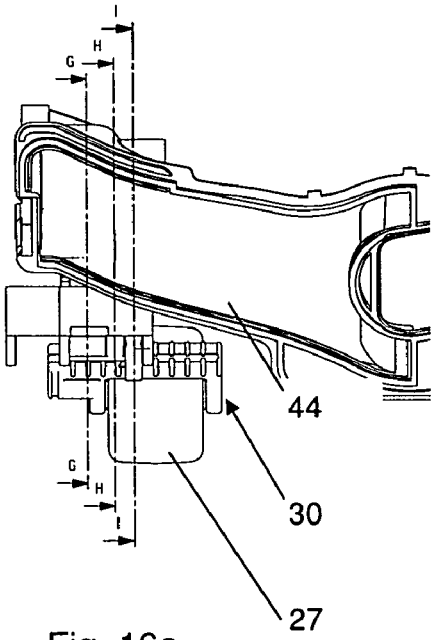
Fig. 16a
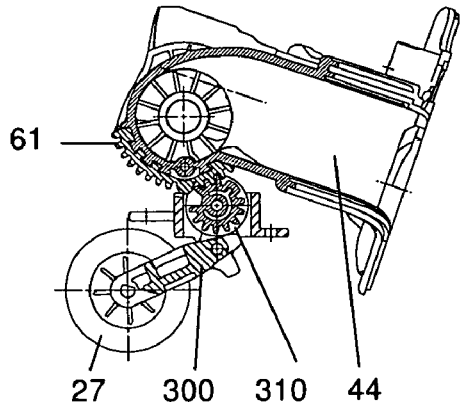
Fig. 16b Section G - G
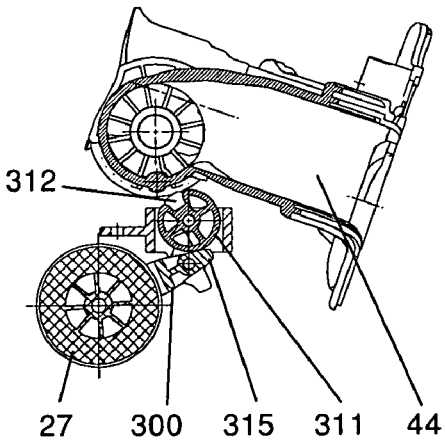
Fig. 16c Section H - H
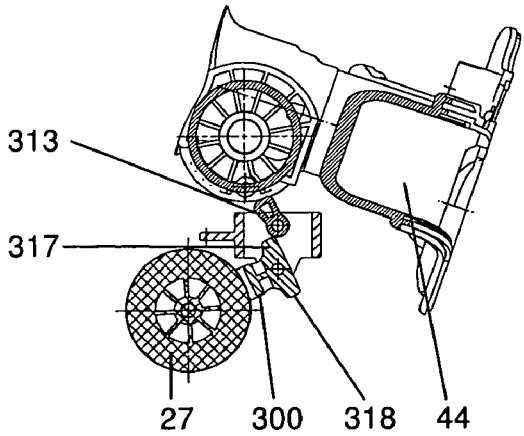
Fig. 16d Section I - I

UPRIGHT VACUUM CLEANER

CROSS REFERENCE TO RELATED APPLICATIONS

Priority is claimed to German patent application DE 10 2007 040 954.2, filed Aug. 30, 2007, which is hereby incorporated by reference herein.

FIELD

The present invention relates to a vacuum cleaner of the upright type, including an upper body provided with a handle, a base unit, and a carriage permitting said base unit to move on the surface to be cleaned.

BACKGROUND

The following is a description of three types of vacuum cleaners which differ in design and operation. All of them have as common features a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor-fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor-fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts are tiltable relative to each other and can usually be locked in a parked position in which the upper body is nearly upright when the base unit is located on a horizontal floor in a position of use. In this position, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. The motor-fan unit may be mounted at different locations. WO 2007/008770 A2 describes, for example, securing the fan directly to the upper body. This reduces the ease-of-use because this heavy component produces a torque about the tilt point, which the user must counteract throughout the vacuuming operation. The upright described in WO 2007/008770 A2 has the further drawback is that it is difficult to move from a straight path of travel into a curved path of travel. WO 2004/014209 A1 and EP 0 708 613 A1 describe the fan being configured as a separate unit. Providing a point of rotation between the upper body and the upper region of the fan (EP 0 708 613 A1), or mounting the fan in a rotatable, spherical housing (WO 2004/014209 A1) enables the upright to move along curved paths, thereby improving maneuverability. Also known are uprights in which the motor-fan unit is located in the base unit. In such upright cleaners, the articulated connection between the base unit and the upper body is provided by a hinge-like structure. The air passageway is provided by flexible hoses extending from the base unit to the upper body.

In order to give the user additional options for vacuuming besides vacuum cleaning with the base unit, such as above-the-floor-vacuuming, the air passageway can have an interface and, downstream thereof, a section which is formed by a hose or hose/wand assembly. In most designs, a wand member is held in an insertion receptacle. After removing the wand member from the insertion receptacle, different types of vacuum attachments may be attached to the suction end thereof. The assembly so formed can be used in the same manner as with a conventional canister vacuum cleaner. This is usually done when the upright is in the parked position. It is desired for the vacuum cleaner to remain in this position and not to tip over even when a slight pull is exerted on the hose. WO 2004/014209 A1 describes two alternatives for increasing the stability of an upright in the parked position. In a first variant (FIGS. 1 and 2), the rear wheels are mounted to the upper body and are moved rearward when the upper body is pivoted to an upright position. Such an arrangement of the rear wheels is possible only for small base units that do not have a suction fan. In a second variant (FIG. 6), there is provided an additional stand assembly to increase the footprint in the parked position. This increases the complexity of the design.

Furthermore, vertical stability can be increased by providing the upright with a base unit having a constant, very large footprint. This reduces the ease of maneuverability.

SUMMARY

In view of the above, an aspect of the present invention is to provide an upright vacuum cleaner which is easy to maneuver when it is in motion during use, and which stands securely when in the parked position.

In an embodiment, the present invention provides an upright vacuum cleaner for cleaning a surface. The upright vacuum cleaner includes an upper body with a handle, a base unit and a carriage configured to move the base unit on the surface. The carriage includes a wheel disposed in a rear portion of the base unit. A motor-fan unit is disposed in the base unit and configured to create a partial vacuum at the surface. A tilting joint provides for relative tilting between the upper body and the base unit. The tilting joint has a pivot axis extending in a horizontal direction when the vacuum cleaner is in a position of use. The wheel is mounted on a pivotable carrier member, which has a pivot axle that is spaced apart from a rotatable axle of the wheel. A pivoting mechanism is disposed on the tilting joint in a vicinity of the carrier member and is configured to pivot the carrier member and the wheel during a pivoting movement of the upper body relative to the base unit.

BRIEF DESCRIPTION OF THE DRAWINGS

An exemplary embodiment of the present invention will be described in more detail below and is shown schematically in the drawings, in which:

FIGS. 1 through 6 show various overall views of the vacuum cleaner of the present invention;

FIGS. 14*a* through *d* show, in a top and various cross-sectional views, the left yoke end, the left wheel mechanism and the left rear wheel in the parked position;

FIGS. 15*a* through *d* show, in a top and various cross-sectional views, the arrangement of FIG. 11 during a pivoting movement of the upper body;

FIGS. 16*a* through *d* show, in a top and various cross-sectional views, the arrangement of FIG. 11 after the upper body has been pivoted rearward;

DETAILED DESCRIPTION

Figure 4:
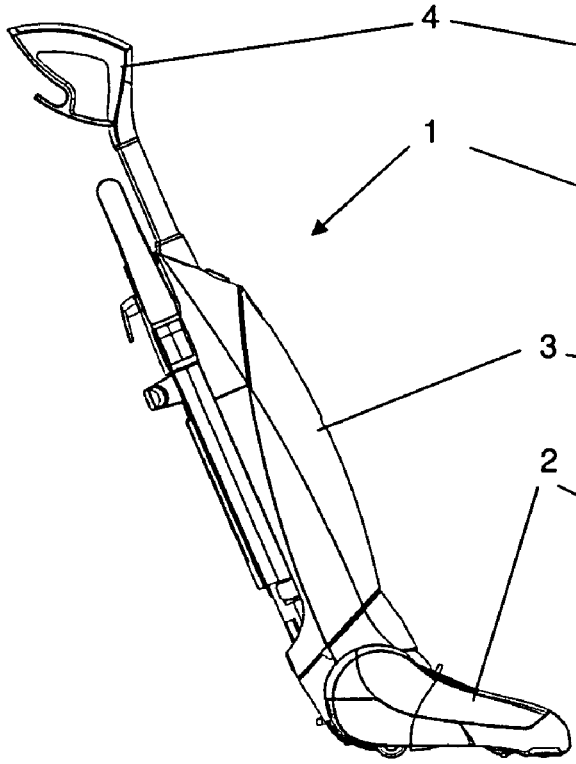

In an embodiment, the present invention relates to a vacuum cleaner of the upright type, including an upper body provided with a handle, a base unit, a carriage permitting said base unit to move on the surface to be cleaned, and a motor-fan unit which is located in the base unit and used for creating a partial vacuum to act on the surface to be cleaned, the vacuum cleaner further including a tilting joint enabling the upper body and the base unit to be tilted relative to each other about an axis extending horizontally in a position of use; the carriage including at least one wheel disposed in the rear portion of the base unit.

In an embodiment of the present invention the wheel is mounted to the base unit by means of a pivotable carrier member whose pivot axle is spaced apart from the rotating axle of the wheel, and by a mechanism which is provided on the tilting joint and in the region of the carrier member and which, during a pivoting movement of the upper body relative to the base unit, cooperate so as to pivot the carrier member together with the wheel. Thus, the footprint in the parked position can easily be increased without the user having to make any manual adjustment. This mechanism portions on the tilting joint and in the region of the carrier can cooperate in such a manner that pivoting the upper body into an upright position will cause the wheel to be pivoted rearward, thereby increasing the distance between the wheel and the front portion of the base unit.

Secure standing, maneuverability, and stability are improved by enabling the wheels to be pivoted rearward to a position in which the projection of the center of gravity of the vacuum cleaner onto the surface to be cleaned is located within the footprint of the base unit, and/or by providing two rear wheels that are connected to each other by an axle and/or by arranging at least one caster in the front portion of the base unit. The stability is further enhanced if supports are disposed in front of the casters and if the carrier member and its pivoting path are dimensioned such that when the upper body is in the upright position, the wheel pivots downward until the floor contact area of the base unit is shifted from the caster(s) to the support means.

The movement performed by the upper body when moved upward to the parked position is used to pivot the wheels to the rear position, thereby providing increased ease of use. In an upright in which the tilting joint is provided by a yoke-shaped component whose yoke ends define the pivot axis (X) of the tilting joint and whose bridge portion is secured to the upper body, this can be achieved when the mechanism portion provided on the tilting joint to pivot the carrier member includes at least one toothed segment arranged on a yoke end. The mechanism portion provided in the region of the carrier member can then include an axle carrier and a positioning wheel which acts on the carrier member. The wheel can be locked both when the upper body is in the upright position and, in an end position, when the upper body is in the tilted position. It is advantageous if the means for pivoting the carrier member include a feature which permits freewheeling in the end position. Thus, the pivoting of the carrier member is limited to the transfer of the upright from the parked position to the operating position. There is no further pivoting of the wheels in response to slight deflections of the upper body, so that the ease of movement is not impaired.

The upright vacuum cleaner shown in different views in FIGS. 1 through 6 (hereinafter abbreviated as upright 1) essentially includes a base unit 2, an upper body 3, and a joint disposed therebetween, which will be described in greater detail further on in this specification.

Figure 7:
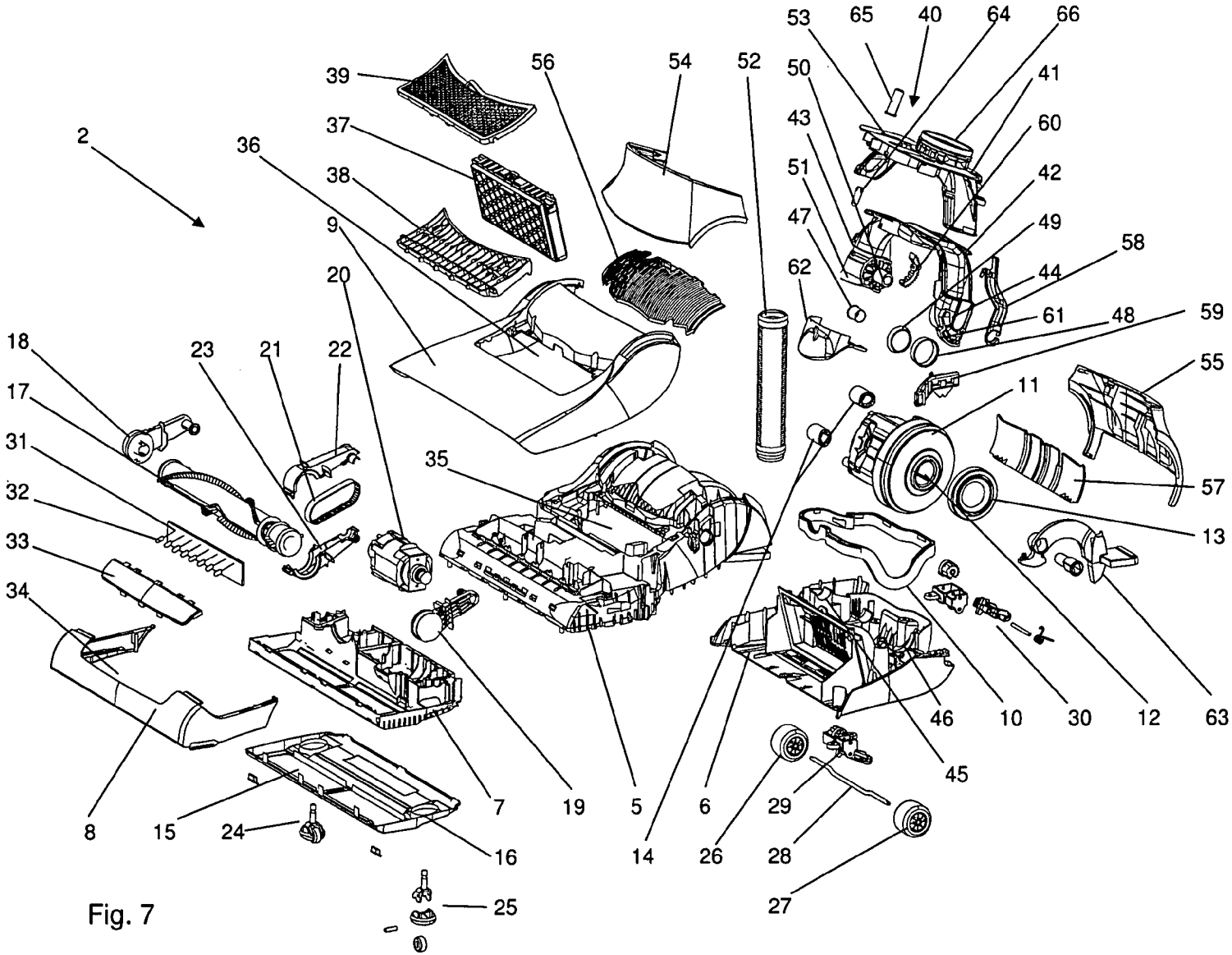
FIG. 7 shows an exploded view showing the base unit of the vacuum cleaner.

Upright 1 can be brought from an upright parked position (see FIGS. 1 through 3), in which it can be locked and stand unsupported, to a tilted position (FIGS. 4 and 5), or even to a fully flat operating position (FIG. 6), after the locked engagement has been released (see FIG. 7). To this end, base unit 2 and upper body 3 are connected in such a manner that they can be tilted relative to each other about an axis X extending horizontally in a position of use (see FIG. 5). This pivoting movement is made possible by a joint which is hereinafter referred to gas "tilting joint". In the tilted operating position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as "swivel joint".

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Figure 9:
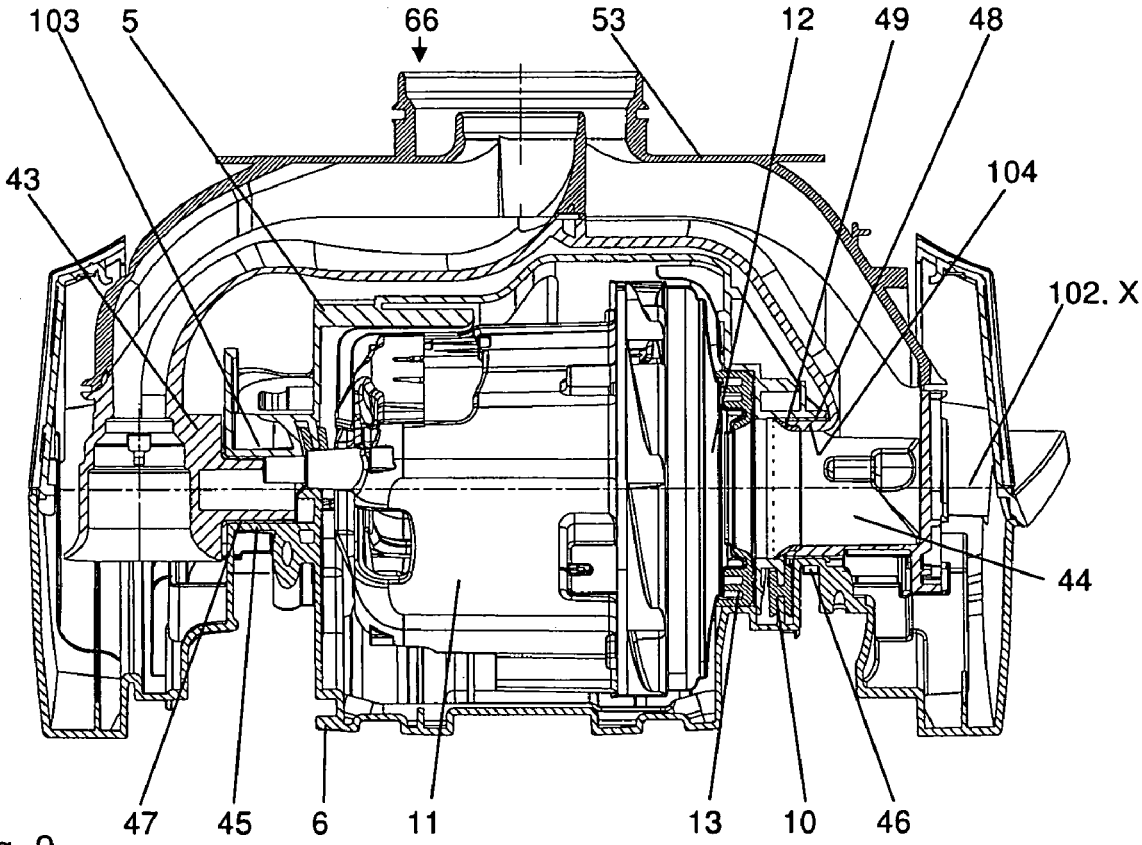
FIGS. 9, 9*a* show longitudinal cross-sectional views of the yoke and parts of the base unit of the vacuum cleaner shown in FIG. 1.
Figure 9A:
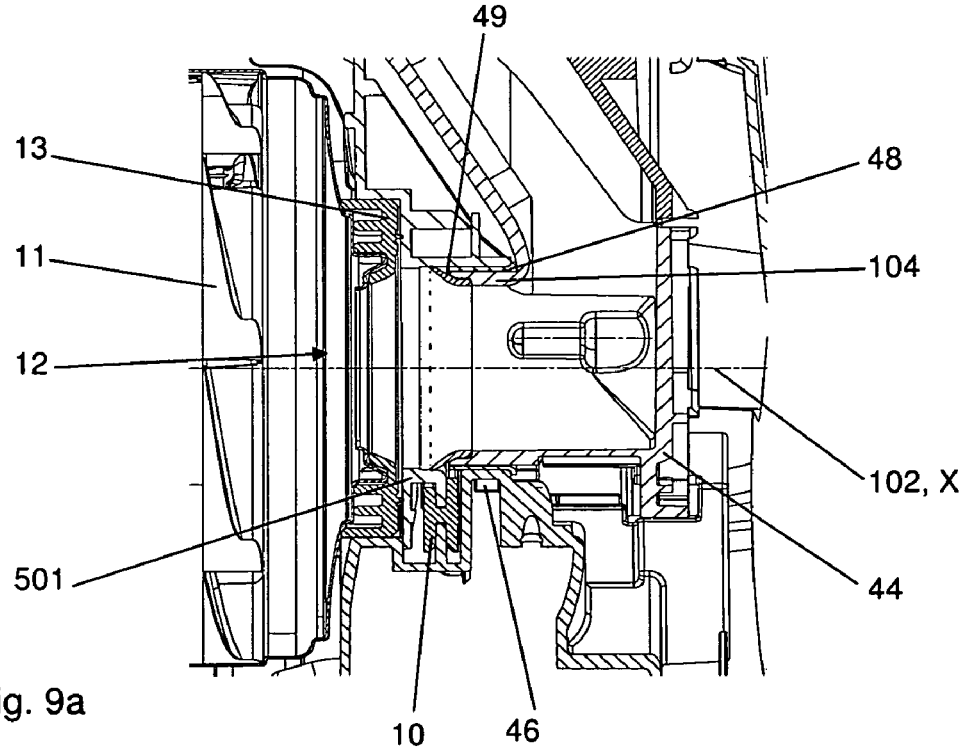

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40 and is shown in FIGS. 9 and 9*a* in the installed position. It is formed by two plastic parts, including an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the parked position (FIGS. 1 through 3), a foot pedal 63 is mounted on housing insert 5 which, in this position, engages with left yoke end 44, thereby preventing yoke 40 from swiveling. The locked position can be released by depressing pedal 63. Moreover, in the parked position, swivel motion is prevented by two spring-mounted pins 64 and 65. In the region of bridge portion 53, the air passages provided by yoke ends 43 and 44 are combined into a first section 66 of a coaxial conduit.

Figure 8:
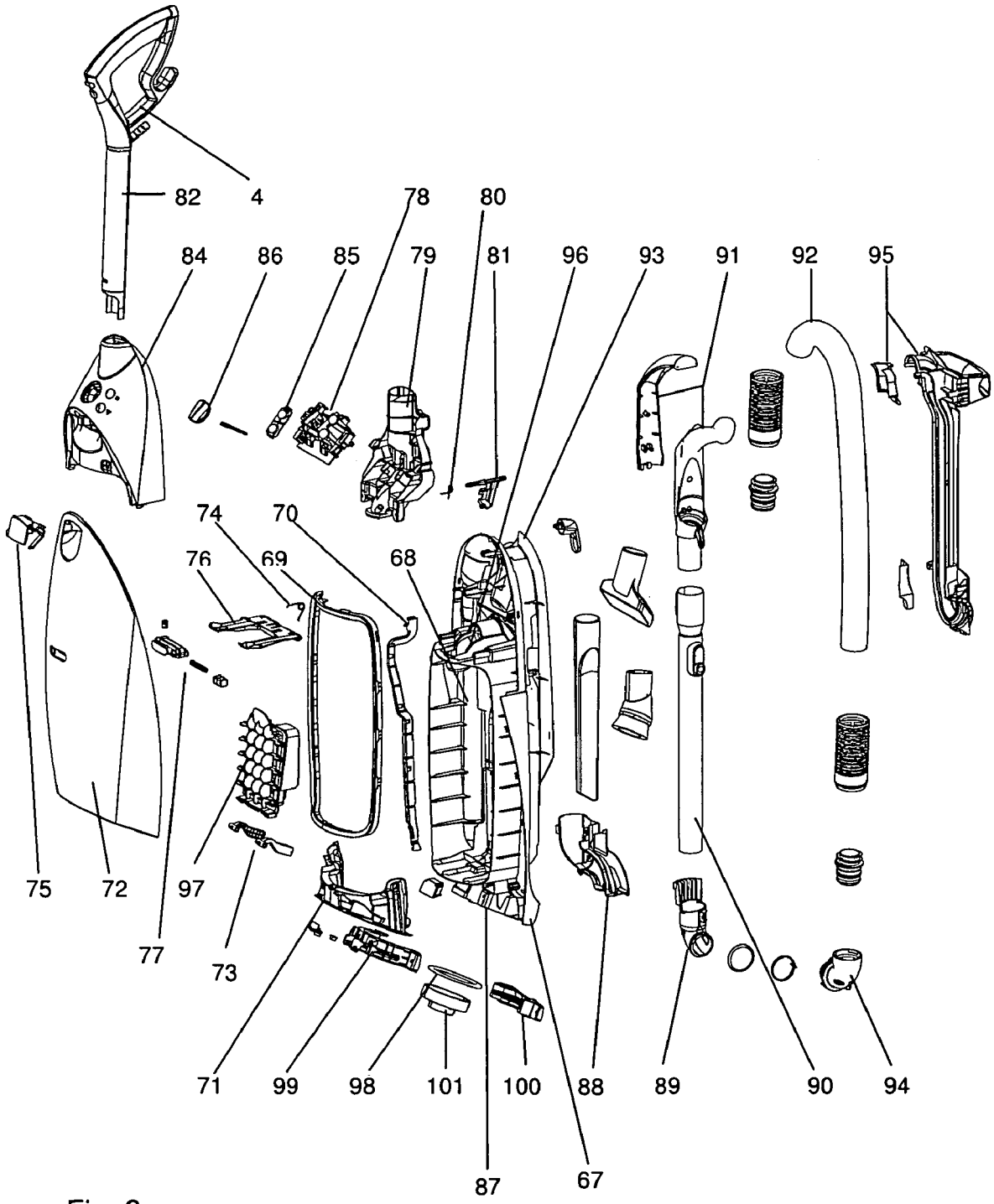
FIG. 8 shows is an exploded view illustrating the upper body of the vacuum cleaner.

FIG. 8 shows upper body 3, also in an exploded view. The load-bearing part of upper body 3 is a rear wall 67. The aforesaid rear wall forms the rear portion of dust chamber 68, which in turn receives a filter bag. A seal 69 surrounds the edge of dust chamber 68, and a covering strip 70 for cables is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4. Electronics 78 are covered by a cap 84, which also serves for attachment of various controls and indicators and accessories thereof (transparent cover 85, rotary knob 86).

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct which extends along the entire length of rear wall 67. The duct is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows only the frame 97 for holding the filter) and into the outer annulus of second section 87 of the coaxial conduit, and from there through first section 66 and left yoke end 44 to motor-fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

In FIG. 9, there can be seen the motor-fan unit 11, which is placed in lower rear housing part 6 and covered by housing insert 5. As already described above, motor chamber seal 10 enables these two components to be connected in an airtight manner because of its H-shaped cross-section. Sealing ring 13 is provided around fan inlet 12 on the suction side, said sealing ring also bearing against the two aforementioned housing parts 5 and 6. The enlarged view of FIG. 9*a* shows that housing insert 5 merges into a sleeve-shaped projection 501 in the region of fan inlet 12. This avoids points of abutment between the two housing parts in this region. As already described above, yoke end 43, which is on the right side as viewed in the direction of travel (out from the plane of the drawing and shown to the left in FIG. 9), is formed as a trunnion and surrounded by a metal bearing sleeve 47. The aforesaid trunnion is supported in an enclosed bearing seat which is formed by opening 45 and a mating opening 103 of housing insert 5 when mounting lower rear housing part 6. Also shown in FIG. 9 is opening 51 into which is inserted the flexible tube member that connects to suction mouth 15 (see FIG. 7). Yoke end 44, which is on the left side as viewed in the direction of travel (shown to the right in FIG. 9.), provides both the air passageway from the upper body to the suction side of fan 11 (fan inlet 12) and the point of rotation for the tilting joint. Therefore, it is hollow and is provided with a seal 49 at its end. Seal 49 bears against projection 501 and provides an airtight passage between fan 11 and yoke end 44. This makes it possible to achieve high suction power. As with the right yoke end, the mounting is provided by a bearing sleeve 48 which is supported in a bearing seat (openings 46 and 104). Axis of rotation X extends along the axis of symmetry of motor-fan unit 11 and is shown as a dashed line 102.

Figure 5:
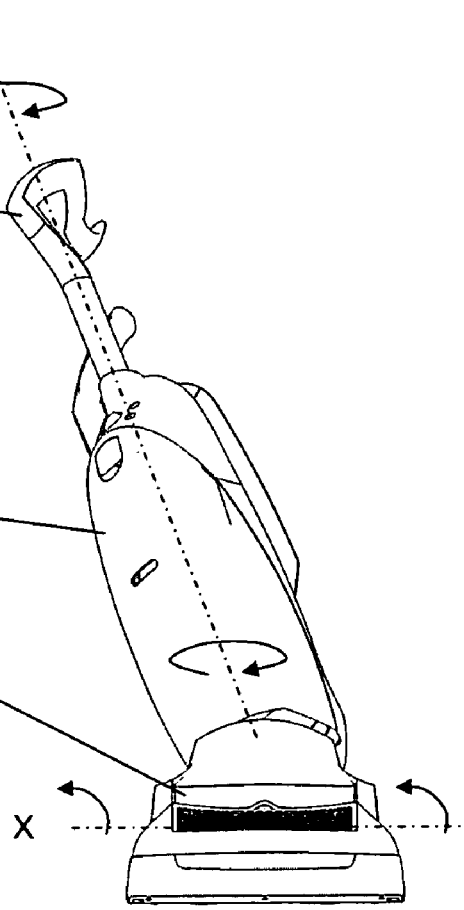
Figure 6:
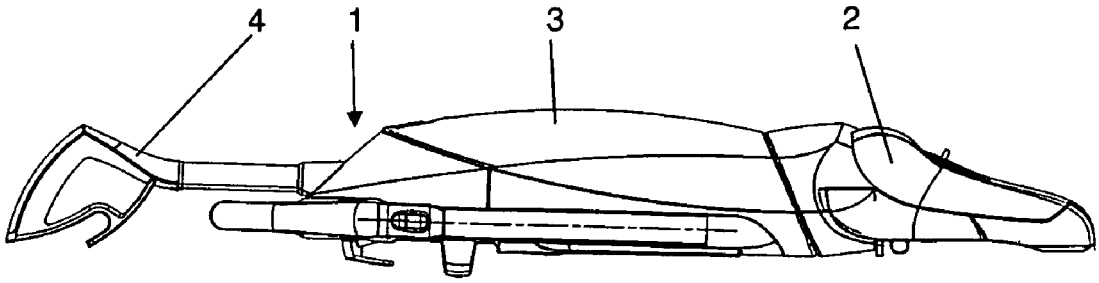

A comparison of FIGS. 2 and 4 already shows that rear wheels 26 and 27 assume different positions depending on the angle of upper body 3. When upper body 3 is in the vertical parked position (FIG. 1), wheels 26 and 27 are in a rear position in which the footprint is increased to such an extent that the vertical projection of the center of gravity of the vacuum cleaner onto the floor is located within the footprint. This allows upright 1 to stand unsupported. When the upper body is pivoted to the operating position (FIG. 4), rear wheels 26 and 27 move forward, thereby improving the maneuverability of upright 1, especially when moving along curved paths. In order to ensure that pivoting upper body 3 about tilt axis X will automatically move rear wheels 26, 27 to their respective proper positions, rear wheels 26, 27 are each provided with a wheel mechanism 29 and 30, respectively, which will be described below with reference to FIGS. 10 through 16.

Figure 10:
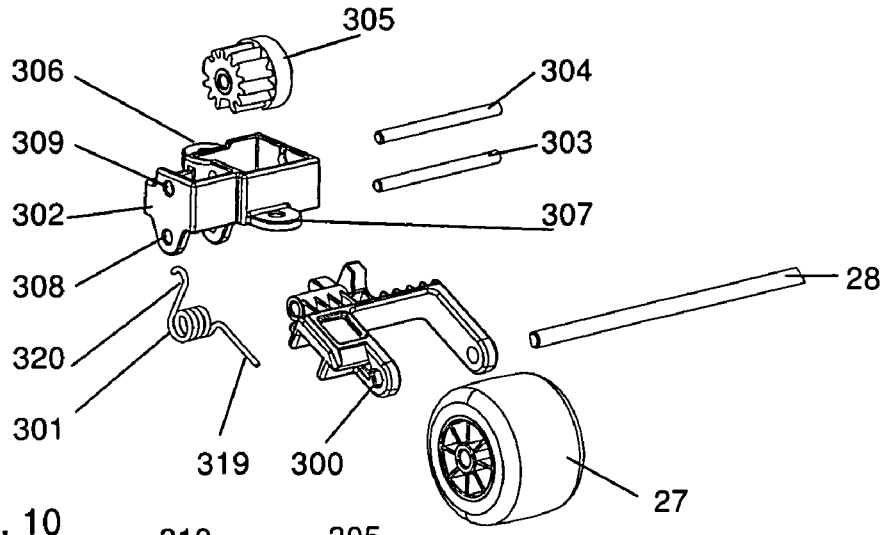
FIG. 10 show an exploded view of a wheel mechanism.
Figure 11:
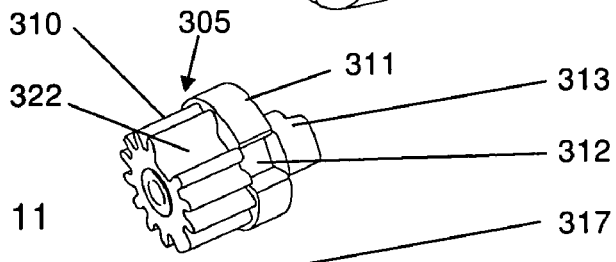
FIG. 11 show an isolated view showing the positioning wheel of the wheel mechanism.
Figure 12:
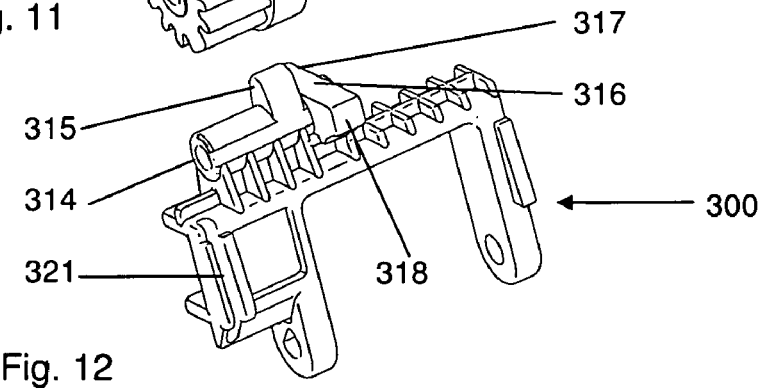
FIG. 12 show an isolated view of the forked carrier member of the wheel mechanism.

FIG. 10 shows a wheel mechanism 30 in an exploded view. The wheel mechanism includes a forked carrier member 300, a torsion spring 301, an axle carrier 302, two axles 303 and 304 and a positioning wheel 305. Rear wheel 27 is held on carrier member 300 and is coupled to the other rear wheel 26 by a connecting axle 28. The carrier member is the part of mechanism 30 which is pivotable and by which the change in position is achieved. Axle carrier 302 is the stationary part of mechanism 30 and is mounted to lower rear housing part 6. To this end, it is provided with two lugs 306 and 307 which are screwed to lower housing part 6. Axle carrier 302 accommodates the two axles 303 and 304 in corresponding bores 308 and 309. Lower axle 303 serves to pivotally support carrier member 300, and upper axle 304 is used to rotatably support positioning wheel 305. As can be see in FIG. 11, positioning wheel 305 includes a toothed ring 310, a driving disk 311 having a recess 312, and an initiator cam 313 located adjacent the recess 312. FIG. 12 shows carrier member 300 in an enlarged isolated view. It can be seen that a driving cam 315 is formed in the immediate vicinity of the bore 314 for axle 303, and an initiator lever 316 extending to both sides is formed adjacent thereto. Driving cam 315 and recess 312 lie in the same plane of rotation; initiator lever 316 is located in the plane of initiator cam 313. Torsion spring 301 is wound around the extension of lower axle 303, which protrudes from bore 314 of carrier member 300. Straight end 319 is supported in a groove 321 on carrier member 300; curved end 320 is supported on the extension of upper axle 304 extending through positioning wheel 305.

Figure 13:
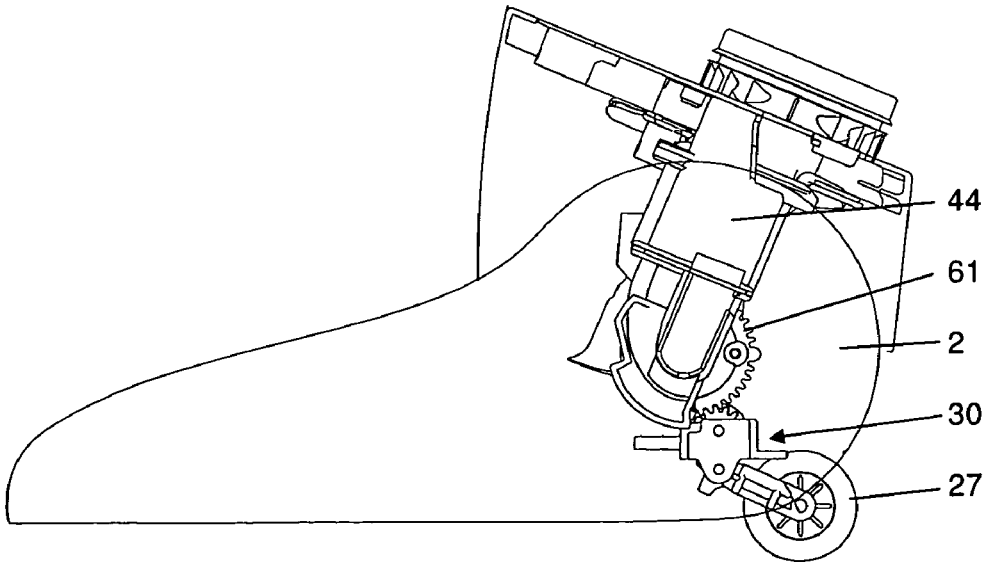
FIG. 13 show a view showing the wheel mechanism and the yoke in the installed position.

In FIG. 13, it can be seen that toothed segment 61 on yoke end 44 meshes with toothed ring 310 of positioning wheel 305. A gap 322 left in the toothing (see FIG. 11) serves to aid in positioning during assembly; it is inserted into a modified tooth 323 of toothed segment 61.

The sequence of movements occurring in wheel mechanism 30 when pivoting upper body 3 from parked position (FIG. 14) during pivoting (FIG. 15) to the tilted operating position (FIG. 16) will now be described with reference to FIG. 14 through 16. The figures show left yoke end 44 and wheel mechanism 30 from above in a top view (a), and three cross-sectional views in different planes of the positioning wheel, namely through toothed ring 310 (b), through driving disk 311 (c), and through initiator cam 313 (d). In the parked position (FIGS. 14*a* through *d*), yoke end 44 is in the one o'clock position, the left end of toothed segment 61 meshes with toothed ring 310 of positioning wheel 305 (FIG. 14*b*). Recess 312 in driving disk 311 has passed the driving cam 315, so that the edge of disk 311 presses cam 315 down and holds it in this position (FIG. 14*c*). Wheel 27 is thereby locked in the rear position. Further rotation of positioning wheel 305 would just cause the edge to run freely on driving cam 315. In this position, spring 301 is tensioned; initiator cam 313 is located in front of right arm 318 of initiator lever 316 and, therefore, is out of its range of action (FIG. 14*d*). When upper body 3 is then tilted rearward (FIGS. 15*a* through *d*), yoke end 44, and thus toothed segment 61, are rotated in a clockwise direction (FIG. 15*b*). Toothed segment 61 then rotates toothed ring 310 in a counterclockwise direction. In this process, initiator cam 313 presses against right arm 318 of initiator lever 316 (FIG. 15*d*), thereby slightly pivoting carrier member 300 in a clockwise direction. This rotation through an angle of a few degrees is sufficient to urge driving cam 315 into recess 312 of driving disk 311 (FIG. 15*c*). As yoke end 44 is pivoted further, recess 312 carries with it the driving cam 315, thereby pivoting carrier member 300 and rear wheel 27 forward, i.e., in a clockwise direction. Torsion spring 301 relaxes and assists in this movement. When upper body 3 is pivoted further, it moves to the operating position. FIGS. 16*a* through *d* show yoke end 44 in the four o'clock position after upper body 3 has been pivoted to the maximum extent, i.e., when it is in a horizontal position. In this position, the right end of toothed segment 61 meshes with toothed ring 310 (FIG. 16*b*). Positioning wheel 305 has been rotated to a point where driving cam 315 has moved out of recess 312 and is pressed down by the edge of driving disk 311. Thus, in this position, too, rear wheel 27 is locked, and positioning wheel 305 runs freely. Spring 301 is in a relaxed state and initiator cam 313 is out of engagement with the initiator lever 316 (FIG. 16*d*). When the yoke end is then pivoted back in a counterclockwise direction to a point where initiator cam 313 abuts against left arm 317 of initiator lever 316, driving cam 315 is again urged into the recess of driving disk 311, thus causing carrier member 300 to pivot rearward.

Figure 17:
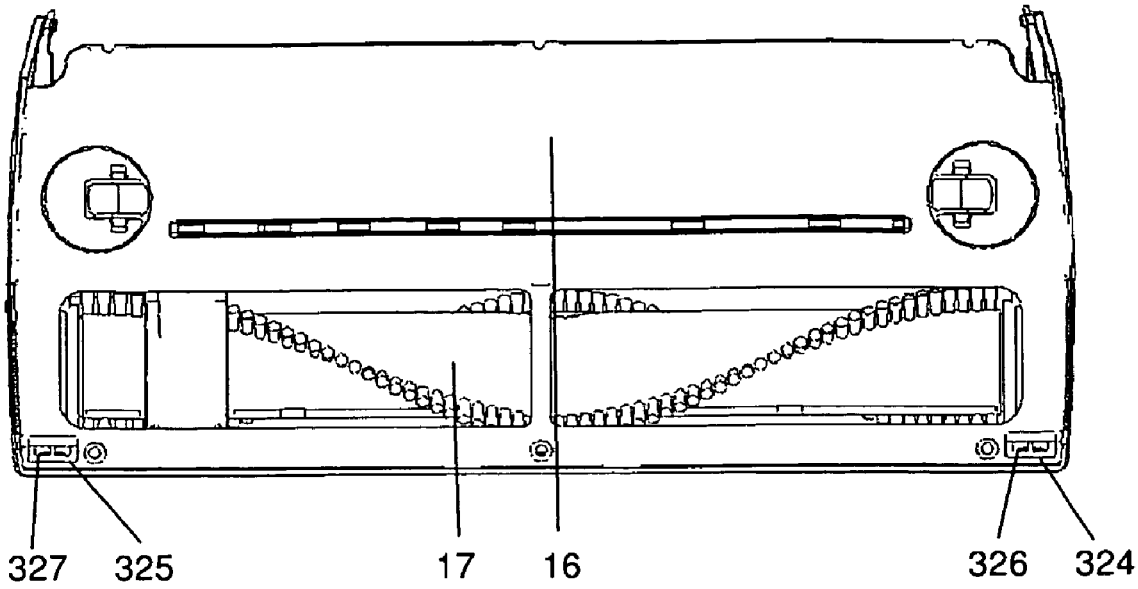
FIG. 17 show a view from below of the bottom plate and the brush roller.

The comparison of FIGS. 14 and 16 further reveals that in the parked position, rear wheels 26 and 27 are pressed to a further downward position. Because of this, the rear portion of base unit 2 is raised to a position where the front portion of the base unit no longer stands on casters 24 and 25, but on rubber supports 324 and 325 which are specifically provided for this purpose and, in addition, serve to frame secondary air openings 326 and 327 in bottom plate 16 (see FIG. 17). Thus, casters 24, 25 are lifted off the floor and no longer serve to assist in a possible traveling movement of the base unit. Such movement is then checked by the contact of rubber supports 324 and 325 with the floor in the parked position.

The present invention has been described herein based on one or more exemplary embodiments, but is not limited thereto. Reference should be had to the appended claims.

What is claimed is:

1. An upright vacuum cleaner for cleaning a surface, the upright vacuum cleaner comprising:

an upper body having a handle;

a base unit;

a carriage configured to move the base unit on the surface, the carriage including a wheel disposed in a rear portion of the base unit;

a motor-fan unit disposed in the base unit and configured to create a partial vacuum at the surface;

a tilting joint operable to provide relative tilting between the upper body and the base unit about a pivot axis extending in a horizontal direction when the vacuum cleaner is in a position of use;

a pivotable carrier member having the wheel disposed thereon, the carrier member having a pivot axle that is spaced apart from a rotatable axle of the wheel; and a pivoting mechanism disposed on the tilting joint in a vicinity of the carrier member and configured to pivot the carrier member and the wheel during a pivoting movement of the upper body relative to the base unit.

2. An upright vacuum cleaner for cleaning a surface, the upright vacuum cleaner comprising:

an upper body having a handle;

a base unit;

a carriage configured to move the base unit on the surface, the carriage including a wheel disposed in a rear portion of the base unit;

a motor-fan unit disposed in the base unit and configured to create a partial vacuum at the surface;

a tilting joint operable to provide relative tilting between the upper body and the base unit about a pivot axis extending in a horizontal direction when the vacuum cleaner is in a position of use;

a pivotable carrier member having the wheel disposed thereon, the carrier member having a pivot axle that is spaced apart from a rotatable axle of the wheel; and a pivoting mechanism disposed on the tilting joint in a vicinity of the carrier member and configured to pivot the carrier member and the wheel during a pivoting movement of the upper body relative to the base unit, wherein the pivoting mechanism and the carrier member are configured to cooperate so that a pivoting of the upper body into an upright position results in the wheel being pivoted rearward such that a footprint of the base unit is larger when the upper body is in an upright position than when the upper body is in a pivoted operating position.

3. The vacuum cleaner as recited in claim 2 wherein the pivoting mechanism is configured to pivot the wheel rearward to a position in which a projection of the center of gravity of the vacuum cleaner on the surface is disposed within the footprint of the base unit.

4. The vacuum cleaner as recited in claim 1 further comprising another wheel disposed on another pivotable carrier member, wherein each of the wheel and the another wheel are rear wheels and are connected to each other by an axle.

5. The vacuum cleaner as recited in claim 1 further comprising at least one caster disposed in a front portion of the base unit.

6. The vacuum cleaner as recited in claim 5 further comprising a support disposed in front of the at least one caster, and wherein the carrier member is configured to have a pivoting path such that the wheel pivots downward until a floor contact area of the base unit is shifted from the caster to the support in an upright position of the upper body.

7. The vacuum cleaner as recited in claim 1 wherein the tilting joint includes a yoke-shaped component including yoke ends and a bridge portion, wherein the yoke ends define the pivot axis and wherein the bridge portion is secured to the upper body.

8. The vacuum cleaner as recited in claim 7 wherein the pivoting mechanism includes at least one toothed segment disposed on the yoke end.

9. The vacuum cleaner as recited in claim 8 wherein the pivoting mechanism includes an axle carrier and a positioning wheel configured to act on the carrier member.

10. An upright vacuum cleaner for cleaning a surface, the upright vacuum cleaner comprising:

an upper body having a handle;

a base unit;

a carriage configured to move the base unit on the surface, the carriage including a wheel disposed in a rear portion of the base unit;

a motor-fan unit disposed in the base unit and configured to create a partial vacuum at the surface;

a tilting joint operable to provide relative tilting between the upper body and the base unit about a pivot axis extending in a horizontal direction when the vacuum cleaner is in a position of use;

a pivotable carrier member having the wheel disposed thereon, the carrier member having a pivot axle that is spaced apart from a rotatable axle of the wheel; and a pivoting mechanism disposed on the tilting joint in a vicinity of the carrier member and configured to pivot the carrier member and the wheel during a pivoting movement of the upper body relative to the base unit, wherein the upper body is configured to assume an upright position and a tilted position with an end position, wherein the wheel is locked when the upper body is in either of the upright position and the end position.

11. The vacuum cleaner as recited in claim 10 wherein the pivoting mechanism is configured to permit freewheeling when the upper body is in the end position.

12. The vacuum cleaner as recited in claim 3 further comprising another wheel disposed on another pivotable carrier member, wherein each of the wheel and the another wheel are rear wheels and are connected to each other by an axle.

13. The vacuum cleaner as recited in claim 3 further comprising at least one caster disposed in a front portion of the base unit.

14. The vacuum cleaner as recited in claim 13 further comprising a support disposed in front of the at least one caster, and wherein the carrier member is configured to have a pivoting path such that the wheel pivots downward until a floor contact area of the base unit is shifted from the caster to the support in an upright position of the upper body.

15. The vacuum cleaner as recited in claim 3 wherein the tilting joint includes a yoke-shaped component including yoke ends and a bridge portion, wherein the yoke ends define the pivot axis and wherein the bridge portion is secured to the upper body.

16. The vacuum cleaner as recited in claim 15 wherein the pivoting mechanism includes at least one toothed segment disposed on the yoke end.

17. The vacuum cleaner as recited in claim 16 wherein the pivoting mechanism includes an axle carrier and a positioning wheel configured to act on the carrier member.

18. The vacuum cleaner as recited in claim 3 wherein the upper body is configured to assume an upright position and a tilted position with an end position, wherein the wheel is locked when the upper body is in either of the upright position and the end position.

19. The vacuum cleaner as recited in claim 18 wherein the pivoting mechanism is configured to permit freewheeling when the upper body is in the end position.

* * * * *